US010253955B2

(12) United States Patent
Wang et al.

(10) Patent No.: US 10,253,955 B2
(45) Date of Patent: Apr. 9, 2019

(54) LAMP WITH ROTATIONAL AND LINEAR MOVEMENT

(71) Applicant: GE Lighting Solutions, LLC, East Cleveland, OH (US)

(72) Inventors: Tingting Wang, ShangHai (CN); Shuyi Qin, ShangHai (CN); Qi Long, ShangHai (CN); Yong Li, ShangHai (CN); Sheng Jiang, ShangHai (CN)

(73) Assignee: GE Lighting Solutions, LLC, East Cleveland, OH (US)

( * ) Notice: Subject to any disclaimer, the term of this patent is extended or adjusted under 35 U.S.C. 154(b) by 0 days.

(21) Appl. No.: 15/367,138

(22) Filed: Dec. 1, 2016

(65) Prior Publication Data

US 2017/0159915 A1 Jun. 8, 2017

(30) Foreign Application Priority Data

Dec. 2, 2015 (CN) ..... 2015 1 0875428

(51) Int. Cl.
*F21K 9/23* (2016.01)
*F21V 3/00* (2015.01)
(Continued)

(52) U.S. Cl.
CPC ..... *F21V 17/02* (2013.01); *F21K 9/23* (2016.08); *F21V 3/00* (2013.01); *F21V 19/02* (2013.01); *F21V 29/70* (2015.01)

(58) Field of Classification Search
CPC ..... F21V 17/02; F21V 21/22; F21V 15/012; F21V 19/02; F21V 21/14
See application file for complete search history.

(56) References Cited

U.S. PATENT DOCUMENTS 6,764,204 B1 * 7/2004 Peters ..... A01K 31/19 362/285
8,967,831 B2 3/2015 Chien
(Continued)

FOREIGN PATENT DOCUMENTS

CN 101995003 A 3/2011
CN 202834926 U 3/2013
(Continued)

OTHER PUBLICATIONS

International Search Report and Written Opinion issued in connection with corresponding PCT Application No. PCT/US2016/064496 dated Feb. 2, 2017.

*Primary Examiner* — Alexander K Garlen
(74) *Attorney, Agent, or Firm* — Peter T. DiMauro; GPO Global Patent Operation

(57) ABSTRACT

The present invention discloses a lamp, mounted on a socket when in use, comprising a cap, a housing, and a light source, wherein the cap is adapted to connect to the socket, one of the cap and the housing comprises a tubular body, and the other comprises a cylindrical cavity for accommodating the tubular body, and the tubular body rotates in the cylindrical cavity around an axis of the cap and moves along the axial direction of the cap to effect relative rotation and relative telescopic motion between the cap and the housing. The lamp of the present invention allows both relative rotation and relative telescopic motion between the cap and the housing, therefore facilitating adjustment of the illumination direction, and is adaptable to different types of fittings.

2 Claims, 4 Drawing Sheets

(51) Int. Cl.

| | |
|---|---|
| ***F21V 17/02*** | (2006.01) |
| ***F21V 19/02*** | (2006.01) |
| ***F21V 29/70*** | (2015.01) |

(56) References Cited

U.S. PATENT DOCUMENTS

| | | | | |
|---|---|---|---|---|
| 9,115,883 | B1 | 8/2015 | Martin et al. | |
| 2008/0170398 | A1* | 7/2008 | Kim | F21V 21/002 362/260 |
| 2012/0236580 | A1 | 9/2012 | Cheng et al. | |
| 2014/0022777 | A1* | 1/2014 | Chen | F21V 19/02 362/220 |
| 2014/0185287 | A1 | 7/2014 | Cunningham | |
| 2015/0137678 | A1* | 5/2015 | Chiu | F21V 29/70 313/318.12 |

FOREIGN PATENT DOCUMENTS

| | | | |
|---|---|---|---|
| KR | 101424633 | B1 | 8/2014 |
| WO | 2012032454 | A1 | 3/2012 |
| WO | 2014048386 | A1 | 4/2014 |

* cited by examiner

LAMP WITH ROTATIONAL AND LINEAR MOVEMENT

TECHNICAL FIELD

The present invention relates to the technical field of lighting, and specifically relates to a lamp which allows both relative rotation and relative telescopic motion between a cap and housing.

BACKGROUND ART

Typically, a lamp comprises a cap, housing and light source, where at least a part of the light source is accommodated in the housing, the lamp is used by mounting of the cap on a socket, and common modes of connecting the cap and housing include insert-pull out, insert-rotate, or rotate. Upon mounting the lamp on the socket, the positions of the lamp and socket are fixed with respect to each other, and the lamp cannot undergo rotational or telescopic movement with respect to the socket, thereby causing considerable inconvenience. For example, upon mounting a directional LED lamp on the socket, because the lamp is unable to rotate relative to the socket, it is sometimes impossible to adjust the LED light source to illuminate the desired direction. Furthermore, lamps come in a vast array of shapes and sizes, and as the lamp cannot extend or contract relative to the socket, in many cases where the lamp is installed in the fitting, the center of illumination may not match the optical center of the fitting, thereby resulting in the issue of uneven illumination.

SUMMARY OF THE INVENTION

In order to resolve the issues above, the objective of the present invention is to disclose a lamp which allows both relative rotation and relative telescopic motion between a cap and its housing, thereby facilitating adjustment of illumination direction, which is also adaptable to different types of fittings.

The lamp of the present invention, mounted on a socket when in use, comprises a cap, a housing, and a light source, wherein the cap is adapted to connect to the socket, one of the cap and the housing comprises a tubular body, and the other comprises a cylindrical cavity for accommodating the tubular body, and the tubular body rotates in the cylindrical cavity around an axis of the cap and moves along the axial direction of the cap to effect relative rotation and relative telescopic motion between the cap and the housing.

As an embodiment, one of the outside surface of the tubular body and the side wall of the cylindrical cavity has a protrusion, while the other has at least two circular slots and at least one linear slot, the protrusion slides in any one of the at least two circular slots to effect relative rotation between the cap and the housing, and the protrusion slides in at least one of the linear slots to effect relative telescopic motion between the cap and housing.

In another embodiment, the tubular body comprises a rigid portion and a flexible portion, the outside surface of the flexible portion has a positioning member, the side wall of the cylindrical cavity has at least two circular slots, the positioning member slides in any one of the at least two circular slots to effect relative rotation between the gap and the housing, and the positioning member moves across the at least two circular slots through an elastic deformation of the flexible portion to effect relative telescopic motion between the cap and the housing.

DETAILED DESCRIPTION OF THE PREFERRED EMBODIMENTS

The present invention will now be described in further detail with reference to the accompanying drawings and specific embodiments.

Figure 1:
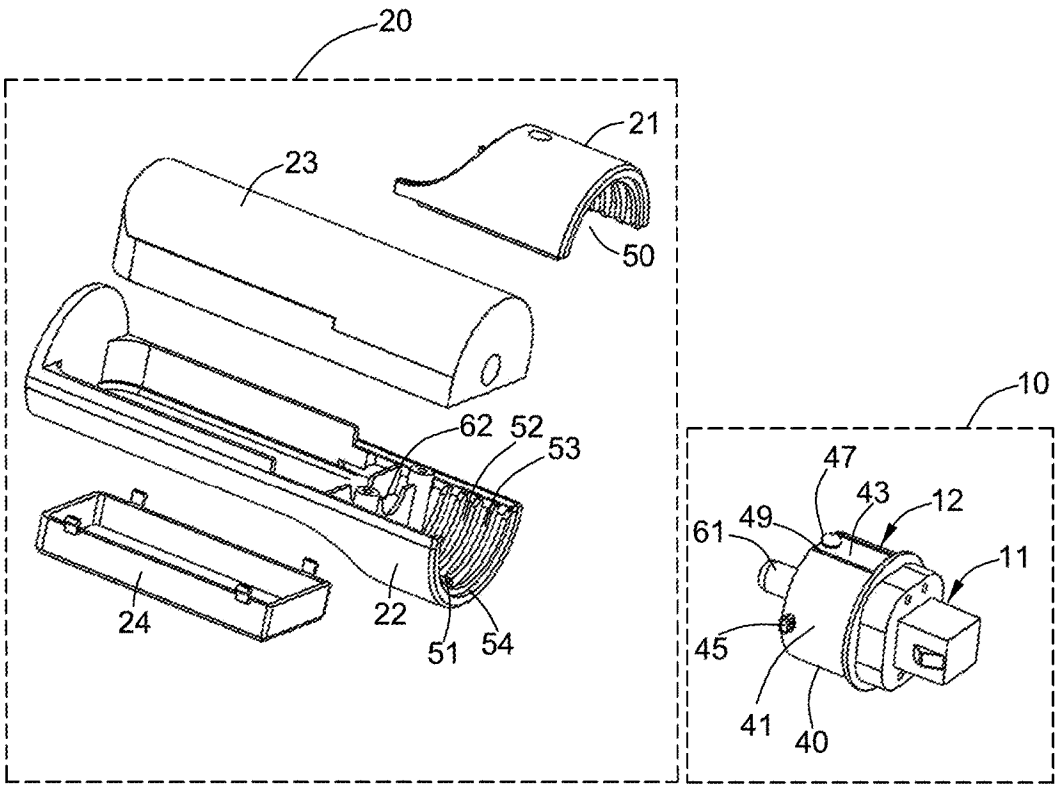
FIG. 1 is an exploded view of the first embodiment of the present invention.

FIG. 1 shows an exploded view of a lamp according to a first embodiment of the invention, the lamp comprising a cap 10, housing 20, and a light source (not shown) at least partially accommodated within the housing 20.

The cap 10 comprises a rigidly connected first portion 11 and a second portion 12, the first portion 11 of the cap is adapted to connect to a socket (not shown), the second portion 12 of the cap comprises a tubular body 40, the axis of the tubular body 40 being the axis of the cap 10, and the tubular body 40 has opposing first end and second end, wherein the first end of the tubular body 40 is rigidly connected to the first portion 11 of the cap. The tubular body 40 comprises two rigid portions 41, 42 and two flexible portions 43, 44, the two rigid portions 41, 42 being the same in size and symmetrical in position, and the two flexible portions 43, 44 being the same in size and symmetrical in position, the rigid portions 41, 42 and the flexible portions 43, 44 are formed by four slits 49 longitudinally laid out along the tubular body 40, each slit 49 either running through the tubular body 40 or running through a part of the second end of the tubular body 40 near the tubular body 40, the larger areas between two adjacent slits 49 being the rigid portions 41, 42, while the smaller areas between two adjacent slits 49 being the flexible portions 43, 44, with one end of the flexible portions 43, 44 rigidly connected to the first portion 11 of the cap, while the other end may undergo elastic deformation under the action of an external force to move closer to or further away from the axis of the tubular body 40. An outside surface of one of the rigid portions 41 has a protrusion 45, and outside surfaces of both flexible portions 43, 44 respectively have positioning members 47, 48 (positioning member 48 is not shown), wherein in the first embodiment, protrusion 45 is a cylindrical protrusion, and positioning members 47, 48 are smooth surface hemispherical protrusions, the positioning members 47, 48 having the same height as protrusion 45, but the diameter of the hemispherical protrusions being slightly greater than the width of the protrusion 45. Protrusion 45 and positioning members 47, 48 can also take other shapes and sizes. Moreover, cap 10 further comprises a limiting column 61, extending along the axis of the tubular body 40, one end of the limiting column 61 rigidly connected to the first portion 11 of the cap, with the other end freely extending beyond the tubular body 40.

Figure 2:
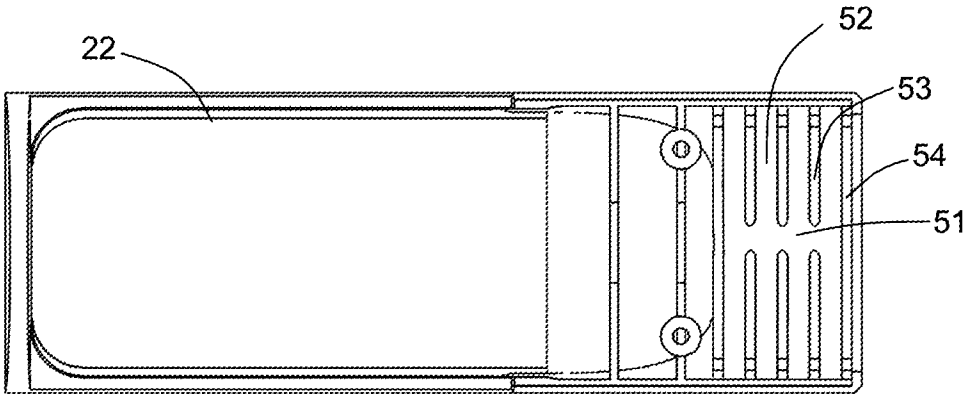
FIG. 2 is a bottom elevation view of the bottom cover 22 of the first embodiment of the present invention.

The housing 20 comprises two top covers 21, 23, a bottom cover 22, and a shade 24. At least one portion of the top cover 21 and at least one portion of the bottom cover 22 may enclose a cylindrical cavity 50, the cylindrical cavity 50 can accommodate the tubular body 40, the top cover 23 is adapted to accommodate the light source, while the top cover 23 may further comprise a heat dissipation member. The side wall of the cylindrical cavity 50 has a plurality of circular slots 52 and a linear slot 51, permitting the protrusion 45 of the rigid portion 41 of the tubular body 40 to slide freely therein. As shown in FIG. 2, the circular slots 52 are formed from a plurality of circular protrusions 53 positioned at equally-spaced intervals on the side wall of the cylindrical cavity 50, the width of each circular slot 52 is greater than the width of the protrusion 45, but is slightly less than the diameter of the positioning members 47, 48, therefore when the positioning members 47, 48 slide within the circular slot 52, they function to increase the friction of rotation. The linear slot 51 is positioned at the bottom of the cylindrical cavity 50 along the longitudinal direction thereof, and is formed by removing a portion of the bottom of the circular protrusions 53, such that the linear slot 51 joins the circular slot 52, and the protrusion 45 is able to slide from the linear slot 51 into the circular slot 52 or from the circular slot 52 into the linear slot 51, while the circular protrusion 54 near the opening of the cylindrical cavity 50 is intact, and is adapted to form the circular slot 52 closest to the opening while also serving as a blocking member of the linear slot 51 to prevent the protrusion 45 detaching from the linear slot 51 during its movement therein. Moreover, the top cover 23 further comprises a limiting hole 62, which is positioned on the axis of the cylindrical cavity 50 and mates with the limiting column 61 of the cap 10; upon completing assembly of the lamp of the present embodiment, the limiting column 61 is inserted into the limiting hole 62, and remains there throughout the relative rotation and relative telescopic movement of the cap 10 and the housing 20 so as to prevent the housing 20 and the cap 10 from breaking apart due to the large radial forces experienced at the point of furthest distance between the cap 10 and the housing 20.

Figure 3:
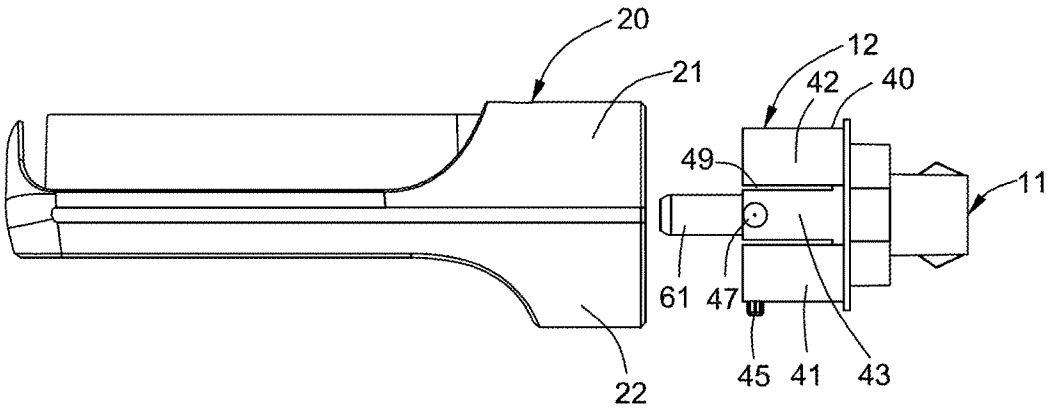
FIG. 3 is a front view of the first embodiment of the present invention.
Figure 4:
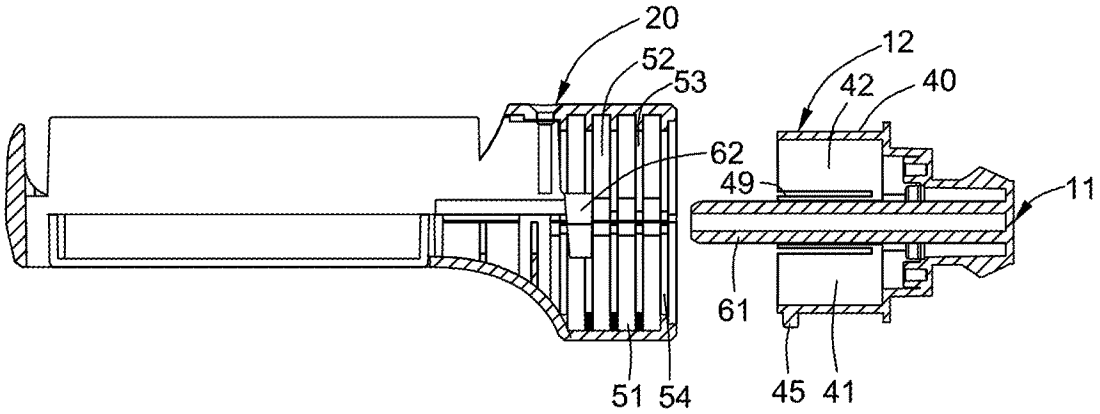
FIG. 4 is a cutaway view of FIG. 3.

FIG. 3 shows a front view of the lamp according to the first embodiment of the invention, while FIG. 4 shows a cutaway view of the lamp according to the first embodiment of the invention. In order to facilitate installation of the lamp, the limiting column 61 of the cap 10 is typically first inserted into the limiting hole 62 of the housing 20, whereupon the tubular body 40 is fitted between the top cover 21 and bottom cover 22 of the housing 20 before assembling the top cover 21 and bottom cover 22 together, so that the tubular body 40 is enclosed within the cylindrical cavity 50.

When the tubular body 40 is in place inside the cylindrical cavity 50, the axis of the cylindrical cavity 50 coincides with the axis of the tubular body 40, which is also the axis of the cap 10. As the protrusion 45 of the tubular body 40 slides within one of the circular slots 52, relative rotation is enabled between the cap 10 and the housing 20, while the positioning members 47, 48 also slide within the circular slots 52 corresponding to their positions, and serve to increase friction during the rotation process; when the protrusion 45 in the circular slot 52 slides to the point of intersection with the linear slot 51, relative telescopic motion is enabled between the cap 10 and the housing 20, and when the protrusion 45 slides in the linear slot 51, the positioning members 47, 48 move across the plurality of circular slots 52 through an elastic deformation of the flexible portions 43, 44, in addition, after the cap 10 and the housing 20 are adjusted to a particular relative position, the positioning members 47, 48 serve a positioning function to prevent any arbitrary telescopic motion of the cap 10 relative to the housing 20.

In actual use, upon mounting the lamp of the present embodiment on a socket, the first portion 11 of the cap is rigidly connected to the socket, whereupon the operator may, as required, rotate the housing 20 around the axis of the cap 10, and the light source in the housing will rotate along therewith so as to adjust the direction of illumination, or alternatively, once the housing 20 is rotated to a particular angle (i.e. the protrusion 45 enters the linear slot 51), the housing 20 may be pulled in the axial direction of the cap 10 for telescopic adjustment to adjust the relative position of the housing and the cap so as to adapt to the fitting within which the lamp is installed.

The upper limit of relative telescopic motion between the cap 10 and the housing 20 depends on the length of the linear slot 51; the longer the cylindrical cavity, the longer the linear slot 51, and the longer the distance that the protrusion 45 on the outer surface of the tubular body 40 can slide therein, therefore allowing more telescopic adjustment between the cap 10 and housing 20. For a given linear slot 51 length, the precision of telescopic adjustment between the cap 10 and housing 20 will depend on the number of circular slots 52; the greater the number of circular slots 52, the narrower the width of each individual circular slot 52, and the smaller the minimum permissible telescopic adjustment between the cap 10 and the housing 20, i.e. the higher the precision of the telescopic adjustment. Therefore, the length of the linear slot 51 and the number of circular slots 52 may be designed according to specific needs.

As another embodiment, outside surfaces of the two rigid portions 41, 42 of the tubular body 40 each has a protrusion 45, 46 respectively, the two protrusions 45, 46 being positioned along the diameter of a cross section of the tubular body or cylindrical cavity; at the same time, two linear slots 51 are provided on the side wall of the cylindrical cavity 50 to respectively enable sliding of the two protrusions 45, 46, and thereby effect relative telescopic motion between the cap 10 and housing 20. The advantage of having two protrusions 45, 46 is that during the relative rotation of the cap 10 and housing 20, the two protrusions 45, 46 slide within the same circular slot 52 and are able to render the relative rotation between the cap 10 and housing 20 more stable.

The light source for the lamp of any embodiment of the invention may be selected from one of a light emitting diode (LED), organic light emitting diode (OLED), incandescent lamp, halogen lamp, and gas discharge lamp; or the like.

The lamp of a second embodiment of the present invention differs from the lamp of the first embodiment in that no protrusions 45 are provided on the outer surfaces of the rigid portions 41 and 42 of the tubular body 40, and only positioning members 47, 48 are provided on the outer surfaces of the flexible portions 43, 44, while no linear slot 51 is provided on the side wall of the cylindrical cavity 50, instead only the plurality of circular slots 52 are provided. In this arrangement, relative rotation of the cap 10 and the housing 20 is accomplished through positioning members 47, 48 sliding within the circular slots 52, while relative telescopic motion of the cap 10 and the housing 20 is accomplished through the positioning members 47, 48 moving across the circular slots 52 under the elastic deformation of the flexible portions 43, 44.

While the present invention has been described in connection with specific embodiments thereof, it will be understood by those skilled in the art that many modifications and variations can be made thereto. It is therefore to be understood that the appended claims are intended to cover all such modifications and alterations insofar as they fall within the true spirit and scope of the invention.

What we claim is:

1. A lamp adapted to be mounted in a socket comprising:

a cap adapted to connect to the socket;

a housing; and a light source at least partially enclosed in the housing, wherein the cap has a tubular body and the housing has a cylindrical cavity for receiving the tubular body, the tubular body is adapted to rotate around an axis of the cap and move along the axis of the cap to respectively realize relative rotation and linear movement between the cap and the housing;

wherein the tubular body has an outside surface, the cylindrical cavity has the side wall, the outside surface of the tubular body has a protrusion, the side wall of the cylindrical cavity has at least two circular slots, and the protrusion is configured to slide in one of the at least two circular slots to realize relative rotation between the cap and the housing;

wherein the tubular body comprises a rigid portion having a protrusion on an outside surface of the rigid portion and a flexible portion having a positioning member on an outside surface of the flexible portion, the cylindrical cavity has at least two circular slots and at least one linear slot on the side wall of the cylindrical cavity, the positioning member slides in one of the at least two circular slots during relative rotation between the cap and the housing, the positioning member goes across the at least two circular slots through an elastic deformation of the flexible portion during relative linear movement between the cap and the housing.

2. A lamp adapted to be mounted in a socket comprising:

a cap adapted to connect to the socket;

a housing; and a light source at least partially enclosed in the housing, wherein one of the cap and the housing has a tubular body and the other has a cylindrical cavity for receiving the tubular body, the tubular body is adapted to rotate around an axis of the cap and move along the axis of the cap to respectively realize relative rotation and linear movement between the cap and the housing;

wherein the tubular body has an outside surface, the cylindrical cavity has the side wall, one of the outside surface of the tubular body and the side wall of the cylindrical cavity has a protrusion, the other has at least two circular slots and at least one linear slot, the protrusion slides in one of the at least two circular slots to realize relative rotation between the cap and the housing, the protrusion slides in the at least one linear slot to realize relative linear movement between the cap and the housing; and wherein the tubular body comprises a rigid portion having a protrusion on an outside surface of the rigid portion and a flexible portion having a positioning member on an outside surface of the flexible portion, the cylindrical cavity has at least two circular slots and at least one linear slot on the side wall of the cylindrical cavity, the positioning member slides in one of the at least two circular slots during relative rotation between the cap and the housing, the positioning member goes across the at least two circular slots through an elastic deformation of the flexible portion during relative linear movement between the cap and the housing.

* * * * *